US008863414B2

(12) United States Patent
Mohamad

(10) Patent No.: US 8,863,414 B2
(45) Date of Patent: Oct. 21, 2014

(54) FABRIC IRONING APPARATUS

(76) Inventor: Waiel Mohamad, Perth (AU)

( * ) Notice: Subject to any disclaimer, the term of this patent is extended or adjusted under 35 U.S.C. 154(b) by 0 days.

(21) Appl. No.: 13/978,388

(22) PCT Filed: Jul. 4, 2012

(86) PCT No.: PCT/IB2012/053391

§ 371 (c)(1),
(2), (4) Date: Sep. 23, 2013

(87) PCT Pub. No.: WO2013/014560

PCT Pub. Date: Jan. 31, 2013

(65) Prior Publication Data

US 2014/0007470 A1 Jan. 9, 2014

(30) Foreign Application Priority Data

Jul. 22, 2011 (AU) ..... 2011902944

(51) Int. Cl.

| | |
|---|---|
| ***D06F 71/34*** | (2006.01) |
| ***D06F 73/00*** | (2006.01) |
| ***D06F 71/30*** | (2006.01) |
| ***D06F 71/32*** | (2006.01) |
| ***D06F 71/14*** | (2006.01) |
| *D06F 71/36* | (2006.01) |

(52) U.S. Cl.

CPC ..... *D06F 71/30* (2013.01); *D06F 73/00* (2013.01); *D06F 71/32* (2013.01); *D06F 71/14* (2013.01); *D06F 71/34* (2013.01)

USPC ..... 38/16; 38/88

(58) Field of Classification Search

USPC ..... 38/74–77.82, 16, 25, 88; 132/223–229, 132/231, 232; 392/386, 399, 394, 402–406

See application file for complete search history.

(56) References Cited

U.S. PATENT DOCUMENTS

| | | | | |
|---|---|---|---|---|
| 1,030,253 | A | 6/1912 | Doyle | |
| 2,807,896 | A * | 10/1957 | Tay | 38/77.83 |
| 3,703,042 | A * | 11/1972 | Smith | 38/69 |
| 4,199,088 | A * | 4/1980 | Sanko | 223/67 |
| 4,219,724 | A * | 8/1980 | Allvin | 219/243 |
| 4,242,567 | A | 12/1980 | Carter | |
| 4,817,309 | A * | 4/1989 | Frank et al. | 38/15 |
| 5,687,278 | A * | 11/1997 | Turner | 392/406 |
| 6,986,217 | B2 | 1/2006 | Leung et al. | |
| 7,121,024 | B1 | 10/2006 | Clevenberg | |
| D537,983 | S | 3/2007 | Shin | |
| 7,188,442 | B2 * | 3/2007 | Fernandez | 38/81 |
| D561,936 | S | 2/2008 | Leung | |
| 7,640,686 | B2 * | 1/2010 | Wai | 38/97 |

(Continued)

*Primary Examiner* — Ismael Izaguirre
(74) *Attorney, Agent, or Firm* — Marian J. Furst

(57) ABSTRACT

This invention relates to the ironing of fabrics, such as clothes in particular, and provides a compact, light-weight apparatus suitable also for use in various ironing applications. The ironing apparatus comprises first and second fabric-pressing surfaces, supporting arms to which the surfaces are mounted opposite each other, to define a fabric-receiving gap between the surfaces. The supporting arms operate to urge the first surface toward the second, so to narrow the gap from a first, fabric receiving width, to a second, fabric-compressing width effective for exerting crease-reducing pressure on said fabric in the gap, while permitting relative traversing movement between said surfaces and the fabric. The supporting arms may be in the form of a flexible U-shaped member having opposed ends to which the respective pressing surfaces are mounted to be inwardly opposed, and a generally central portion defining a body.

18 Claims, 13 Drawing Sheets

(56) References Cited

U.S. PATENT DOCUMENTS

| | | | | |
|---|---|---|---|---|
| D620,639 | S | 7/2010 | Choi | |
| D665,947 | S | 8/2012 | Bachmann et al. | |
| 2005/0278989 | A1 | 12/2005 | Fernandez | |
| 2008/0196739 | A1 * | 8/2008 | Henninger et al. | 132/224 |
| 2010/0199528 | A1 | 8/2010 | Fabrikant | |

* cited by examiner (a)

(b)

(b)

(a)

(b)

(c)

(a)

(b)

(a)

(b)

FABRIC IRONING APPARATUS

CROSS REFERENCE TO RELATED APPLICATIONS

This application claims priority to copending PCT application no. PCT/IB2012/053391, entitled "Fabric Ironing Apparatus," invented by Waiel Mohamad and filed on Jul. 4, 2012, which claims priority to Australian patent application no. 2011902944, having the same title and inventor, filed on Jul. 22, 2011. Both applications are incorporated herein by reference in their entirety.

FIELD OF INVENTION

This invention relates to the ironing of fabrics, such as clothes in particular, and provides a compact, light-weight, apparatus suitable also for use in various ironing applications.

BACKGROUND TO THE INVENTION

Prior ironing and clothes pressing devices are known. Typically, clothes irons comprise a body having inside a reservoir of water, heating means for producing steam from the water and for heating the usually metallic ironing surface, commonly known as a soleplate. The soleplate may be coated with a non-stick material, for example Teflon®. In use the iron is drawn or pushed across the fabric to be ironed, such fabric being spread across an ironing board or other large flat surface. Steam is emitted through apertures in the ironing surface to assist in crease removal. The combination of heat, moisture and pressure acts to remove wrinkles in the fabric being ironed.

The iron is of substantial weight intended for it to bear down on the fabric spread on the ironing board and assist in wrinkle removal. A disadvantage of such irons is their weight, with users often known to suffer arm, shoulder and back strains. This has led to the use of lighter-weight fabrication materials, which has alleviated the negative physical effects to some extent.

Steam is produced by way of a steam generating system in which a valve, the settings of which are managed by the user, allows water to drip from the reservoir and into a heated chamber located behind the heated soleplate. The heat turns the water to steam, which is then discharged through orifices in the soleplate to contact the fabric being ironed.

Another known crease removing apparatus is the trouser press, which has opposed heated major surfaces, between which a pair of trousers is placed while the surfaces are urged together, heating the fabric for crease removal. A disadvantage of this is its limited range of application and its lack of portability.

Industrial presses are known for the pressing of clothing at places such as laundries. Of course, these are not intended to be portable or hand-held, nor indeed are they. In addition, prior devices of the type described above are considered to be big energy consumers.

OBJECTS OF THE INVENTION

It is an object of this invention to address the shortcomings of the prior art and, in doing so, to provide an ironing device that is not only hand-held, but provides an opposed pair of surfaces, between which a portion of fabric can be placed for the surfaces to traverse it and remove creases.

The preceding discussion of the background to the invention is intended to facilitate an understanding of the present invention. However, it should be appreciated that the discussion is not an acknowledgement or admission that any of the material referred to was part of the common general knowledge in Australia or elsewhere as at the priority date of the present application.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

SUMMARY OF INVENTION

According to a first aspect of the invention there is provided a fabric ironing apparatus comprising first and second fabric-pressing surfaces, support means to which the surfaces are mounted for supporting said surfaces in opposed relationship, thereby to define a fabric-receiving gap between the surfaces for receiving a fabric to be ironed, the support means being operable to urge the first surface toward the second, so to narrow the gap from a first, fabric receiving width, to a second, fabric-compressing width effective for exerting crease-reducing pressure on said fabric in the gap, while permitting relative traversing movement between said surfaces and the fabric.

In a preferred form of the invention, the apparatus comprises orienting means for causing the opposed pressing surfaces to assume a substantially parallel opposed relative mutual orientation in use.

The invention extends to an embodiment in which the support means comprises a flexible U-shaped member having opposed ends defining first and second arms to which the respective pressing surfaces are mounted to be inwardly opposed, and a generally central portion defining a body.

In alternative embodiments, the support means comprises an arm member onto which the first pressing surface is mounted.

In a preferred form of the invention, the support means comprises a body to which the arm member is extensibly connected. In an embodiment, the second pressing surface is mounted on the body.

In an embodiment, the body has extending from it a second arm member, and the second pressing surface is mounted on said second arm member.

In a preferred embodiment, one of the arm members is fixed to the body. Preferably, both of the first and second arm members are movably connected to the body. In an alternative embodiment, at least one arm member is integrally formed with the body, to be in fixed orientation relative to it In a further preferred form of the invention, the support means comprises articulated connection means for movably connecting one or both of said first and second arm members to the body.

Still further, the or each of said first and second arm members may comprise first and second articulatedly interconnected arm portions. In an example, the first arm portion is proximate the body and located between the body and second portion, with the pressing surface being mounted on the second portion.

In a further preferred form of the invention, the surfaces are complementally shaped so that the gap in use is substantially uniform. Preferably, the support means and arm members are articulatedly connected for maintaining a substantially uniform ironing gap between the pressing surfaces in use. In an embodiment, the pressing surfaces are maintained in a substantially parallel relative mutual orientation.

In a preferred embodiment, the support means comprises pressing surface tilt-enabling means allowing adjustment of the gap to compensate for variability in thickness of an article being ironed. Further preferably, the tilt-enabling means comprises biasing means located below one or both of the pressing surfaces. The biasing means maintains the surfaces in generally opposed relationship, while allowing the gap to adjust to different fabric thickness and features such as seams. In exemplary embodiments, the biasing means comprises a rebounding metal plate strap, or a hinge-like recoil mechanism.

In an embodiment the surfaces are of substantially equal area.

In a particularly preferred form of the invention, the ironing apparatus comprises heating means for heating at least one of the surfaces. The heating means preferably comprises electrical heating means. However, the heating means may comprise steam generating means, for providing steam to heat the or each pressing surface. The heat for generating the steam is preferably provided by electrical heating means.

In a preferred embodiment, the support means includes a reservoir for holding a fluid and fluid communication means between the reservoir and the first pressing surface. In a still further preferred form of the invention, the apparatus comprises steam-emitting means for introducing steam into the ironing gap between the surfaces.

In an embodiment, the steam-emitting means comprises orifices associated with at least one of the pressing surfaces. In a preferred embodiment, the orifices pass through the surface. In an alternative embodiment, at least some of the orifices are located adjacent the pressing surface.

In a further preferred embodiment, the orifices are located to emit steam through an upper portion of the pressing surface when said surface is generally vertically orientated in use. The upper portion is preferably located in an area defined above the longest diameter of the pressing surface.

Still further, according to the invention, the steam-generating means comprises a reservoir adapted for holding water at a pressure exceeding ambient conditions, water heating means, and fluid communication means between the reservoir, the water heating means and the steam-emitting orifices. Ideally, the reservoir is adapted to withstand a pressure sufficient to expel water from the reservoir to reach the water heating means.

According to a further preferred form of the invention, the support means includes a heatable steam-generating chamber located behind the or each pressing surface.

In a preferred embodiment, the water heating means comprises a heatable chamber for receiving water expelled from the reservoir. Preferably, the chamber is heatable by means of an electric heating element.

In a further embodiment, the or each pressing surface is in thermal communication with, for receiving heat from, the chamber.

Still further, the chamber is configured to have an inlet for admitting steam or water to the chamber and so that the orifices are located to be above the level of said inlet.

In an embodiment, the first surface has a round cylinder profile.

In a further embodiment, the first and second surfaces are both round cylinders.

In a further preferred embodiment of the invention, the reservoir is mounted externally to the body. The invention comprises positioning means for moving the reservoir from a first, water-retaining position to a second, water-delivering position.

In this embodiment, preferably the first position is generally on the same side of a horizontal plane defined perpendicularly to the plane of one of the pressing surfaces as the body in use. Further preferably, the second position is generally on an opposite side of said plane.

The invention extends further so that the ironing apparatus comprises garment-hanging means. In an embodiment, the hanging means comprises at least two arm members connected at an articulated joint and extensible in different directions to bear upon the fabric being ironed, so as to place it under sufficient tension that it does not readily crease under friction associated with the pressing surfaces traversing it.

In an embodiment, the hanger comprises expansible and retractable means for allowing it to fit the width or length of the fabric being ironed.

In a preferred embodiment, the garment-hanging means comprises an elongate horizontally-extending member having opposed ends distal from a central hanging crook by which to suspend the member, said opposed ends defining upper hanging extremities for supporting a hanging garment, and downwardly extensible spacing means which, when extended, define lower spaced extremities for maintaining the lateral shape of a portion of the garment below a portion receiving support for said upper extremities. Preferably, the horizontally-extending member is telescopically extensible.

In a preferred form of the invention, the horizontally-extending member comprises a vertically extensible element. In an embodiment, the vertically extensible element is connected by articulated connection means to the horizontally-extending element.

According to a second aspect of the invention, there is provided a method of ironing a fabric comprising

- providing ironing apparatus comprising first and second opposable fabric-pressing surfaces, means for supporting said surfaces in opposed relationship to define a fabric receiving gap, and means for urging said surfaces towards each other to narrow the gap from a first, fabric receiving width, to a second, fabric-compressing width effective for reducing creasing in the fabric, while permitting relative traversing movement between said surfaces and the fabric,
- causing the gap to be at fabric-receiving width,
- locating fabric requiring ironing in the gap while the gap is at fabric-receiving width,
- operating the apparatus to urge the surfaces toward each other to narrow the gap to said fabric-compressing width, and
- causing the surfaces to traverse the fabric, so as to reduce creasing present therein to a desired degree.

In a preferred version of the method, it includes the step of heating a pressing surface.

In a preferred embodiment, the method further includes the step of introducing steam to the fabric. Preferably, the method includes causing the apparatus to emit steam into the gap.

In an embodiment, the method comprises providing heating of the surface by electrical means. The method may include indirectly heating the surface with steam.

Preferably, the method comprises causing the gap, when at fabric-compressing width to be maintained substantially constant. The method further preferably includes allowing the gap to be adjusted according to variation in thickness of the fabric being ironed.

BRIEF DESCRIPTION OF DRAWINGS

In order that the invention may be readily understood, and put into practical effect, reference will now be made to the accompanying figures. Thus.

DETAILED DESCRIPTION OF AN EMBODIMENT OF THE INVENTION

Figure 1:
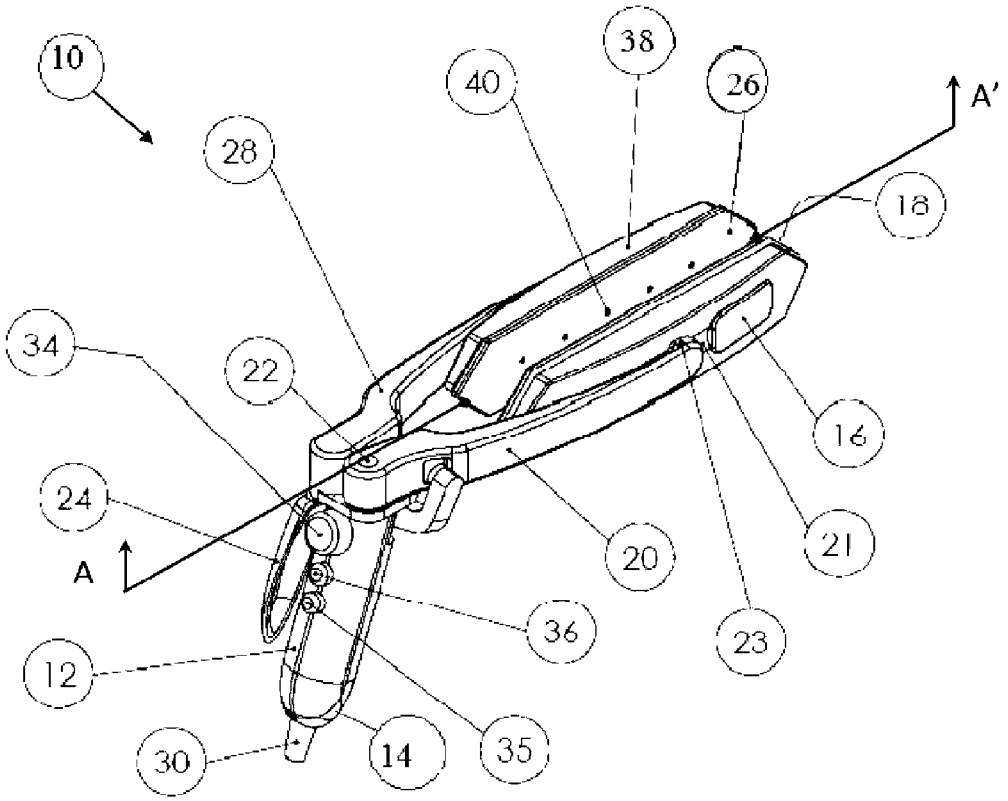
FIG. 1 shows in perspective view a preferred embodiment of the ironing apparatus of this invention.

The ironing apparatus of this invention provides two or more surfaces of sufficient smoothness to be passed across clothing or to traverse other fabrics to be ironed, without catching or noticeably de-threading the fabric concerned. The surfaces are complementally shaped, so that, when positioned in opposed orientation, they define a gap into which a portion of fabric to be ironed is receivable. When urged together, the gap between the surfaces closes, thus to grip or place pressure on the fabric and remove creases, especially when the fabric is drawn through the gap to be traversed on both sides by the surfaces.

In an embodiment, the surfaces are complementally shaped, so that the gap is of substantially uniform gauge. To achieve this uniformity, the complementally-shaped pressing surfaces are preferably substantially planar, being equivalent to the soleplates of mono-plated prior art irons. However, they may be other shapes, for example concave paired with convex. It will be appreciated that when using a conventional mono-plated iron together with an ironing board, the condition of the ironing board is a variable that is a major factor in the success of the ironing operation. Having the opposed surfaces of this invention eliminates this variable.

It is not essential for the gap to be uniform—particularly in profile. Therefore, it is within the scope of this invention for a flat plate to be paired with a round cylinder. In an example of such an embodiment, the round cylinder is rotatable to enable it to roll along the surface of the fabric being ironed, while pinching the fabric between it and the opposing surface. In a further embodiment, both surfaces may comprise rollers, urged together to pinch the fabric and either one or both being heated and having steam-emitting orifices to apply steam to the fabric ahead of the pinch. However, it will be appreciated that one or both cylinders need not be rotatable at all.

By providing heat to at least one of the pressing surfaces, the de-creasing effect of the apparatus can be improved. Similarly, by introducing steam into the gap, the crease-removing capability of the apparatus on the fabric in the gap is also improved. The steam may be emitted from orifices found in one or both of the opposed pressing surfaces, or may be emitted from orifices, including in the form of a slot, located beyond and in particular adjacent to the surfaces.

The steam-generating means comprises a heatable chamber into which water is introduced and allowed to form steam when the chamber is sufficiently heated. The chamber is in fluid communication with a set of orifices associated with the working surface, which too is heatable. The steam expands in the chamber and is forced from the orifices. It is therefore desirable for the chamber to be of minimal dimensions. Typically it is in a tube or channel-like cavity configuration. In one particular embodiment of the invention, the steam chamber contains an internal cellular structure of intercommunicating cells, such as found in an expanded foam or mesh of thermally conducting material defining a heatable lumen, with which water comes into contact to be heated and expanded to steam.

The apertures, that define the orifices for allowing steam to be expelled from the chamber, may be positioned around and beyond the periphery of the pressing surface, or be located within the boundaries of the surface, to be referred to as being in or on the pressing surface. Preferably, the orifices are positioned above the level of the steam-generating chamber or tube when the soleplate supporting arms of the ironing apparatus are extended substantially horizontally. This arrangement of features minimises the chance of water not evaporating, or condensing, and being expelled or leaked via the orifices, such as under gravity. In particularly preferred embodiments, the steam-emitting orifices are located in the portion of the pressing surface that lies above the longest diameter of the pressing surface when the arms are substantially horizontally extended.

In a particularly preferred embodiment, the ironing apparatus has a steam-generating chamber, the outlet of which is governed by a pressure-sensitive unidirectional valve, which opens at a pre-selectable temperature, allowing a gush of steam to escape to the orifices and be injected into the space between the pressing surfaces. When the internal pressure of the chamber reduces to a second, pre-set level, the valve closes and enables steam pressure to build up again before another charge is released. In this way, the egress of water to the orifices is controllably inhibited.

It is also within the scope of this invention for the water heating chamber to be divided into two or even more compartments, so that a first compartment is used for generating a continuous steam stream, while a second is used for generating a supply of steam that is released intermittently, such as at the press of a button my the user to open a release valve. A third compartment may optionally be used for holding a third body of steam for boosting output or to alternate with the second chamber while the second is being replenished and is building up steam pressure.

These options are discussed below with reference to FIG. 5. The pressing surfaces of the ironing apparatus of the invention are supported to be located opposite each other to define a gap between them and for the gap to be narrowed to a distance suitable and effective for clothes ironing. In particular, the gap is closed to a distance at which the fabric being ironed is loosely gripped between the surfaces, so that no more than moderate force needs to be exerted by the user to cause the surfaces to traverse opposite sides of the fabric while the surfaces exert pressure, capable of crease removal, on the fabric.

The support means for the pressing surfaces may take a number of different forms and configurations. In one example, the support means is a pair of arms extending substantially parallel to each other from points of connection to the body, which points are adjacent their proximal ends. When so extended, the arms are shaped to define a gap between them. The arms may be integrally formed with the body, such as in a plastics moulding process, or they may be produced separately and connected to a separately formed body. The body is hollow, as will be discussed more fully below.

In this example, the arms are immovably fixed to the body. Each has attached to it, at a position intermediate their proximal and distal ends, a heatable pad defining a substantially flat pressing surface. The pads face each other across the gap. Preferably, the pads are located closer to the distal ends than the proximal ends. According to this embodiment, both arms are in fixed orientation in relation to the body and only a portion of the arm assembly, which supports a pressing surface, is moveable to be urged toward the opposite pressing surface.

One of the arms is configured to provide means for displacing the heated pressing surface, which is attached to it, towards the opposite pressing surface to close the gap. In this configuration, the displacing means includes, for example, a lever-and-spring system which connects to a trigger, located for ease of use in the hand grip provided for the user, which is found on the body to which the arms are joined. When pressed by the user, the trigger operates the lever-and-spring system to actuate movement of the pressing surface-bearing pad toward the opposite surface, so as to grip and bring pressure on to fabric, when located in the gap for ironing.

In a second example, both of the arms are pivotally connected to the body, to be moveable, either separately or in unison, from a first position, in which they are flanking opposite sides of the body, to a second position, in which they are raised to be extended approximately perpendicularly to the body and substantially parallel to each other. By means of a ratchet-type mechanism, the relative positioning of the arms and body is set and maintained while ironing is performed. A release mechanism allows release of the arm members for position adjustment, if required during ironing and again after ironing, to return the arms to their first, body-flanking position.

When so positioned, the arms define a gap between them, with the respective pads orienated to have their pressing surfaces facing each other across the gap. Again, a trigger and lever/spring-type system is utilised to urge one of the pads towards the other. In another example, a trigger and lever system urges both pads to move in relation to their respective supporting arms and toward each other. Instead of a purely mechanical system to effect relative movement of the surface-bearing pads to each other, the actuation system may be an electro-magnetic actuator, also operated by the user pressing on the trigger associated with the hand-grip of the body. In an example, one of the pads includes an electromagnet and the other is of ferrous metal fabrication. When the trigger is pressed, it closes an electric circuit that energises the electromagnet to draw towards it the facing ferrous pad and pressing surface.

In a preferred embodiment, the support means again comprises a body and two extending arms, to which the respective pressing surfaces are mounted to be spaced from the body and to face toward each other when the arms are extended. The pressing surfaces are defined, as described above, on heatable pads, each of which is fixed to an arm. In this embodiment, the pads are so fixed that only a limited degree of movement is permitted, in particular a limited degree of swivelling movement, sufficient to enable them to continue facing each other and remain substantially parallel when the surfaces are moved to traverse the fabric being ironed between them. Instead of the pad or pads moving in relation to the supporting arm, one arm assembly is movable as a whole towards the other, so as to bring the pressing surfaces into ironing-effective orientation.

The arms are thus connected to the body to be either both fixed or movable in relation to the body, or have only one fixed and the other moveable in relation to the body. One arm may be immovably fixed to the body, or integrally formed with the body, while the other arm is connected to the body by articulated joint means, allowing ratchet-style controllable movement relative to the body and toward and away from the other, fixed arm. By such movement, the pressing surface of the moveable arm is brought closer to or away from the pressing surface on the fixed arm. Preferably, in embodiments wherein only one of the pressing surfaces is directly heatable, the pressing surface of the fixed arm is the heatable surface. In other embodiments, both opposing pressing surfaces are heatable. Furthermore, either or both pressing surface may have steam-emitting orifices associated with them and preferably located in them.

In the case where both arms are moveable in relation to the body, the arms are connected to the body so that both are moveable in relation to the body in at least two planes. In the first such plane, the arms are pivotally movable downwardly, to be positioned in a first position alongside the body, and upwardly to a second, raised position, in which they are approximately perpendicular to the body and their first position, thereby to assume an outwardly extending, human greeting-like posture. In the second plane, the arms are moveable from their second, raised and outwardly-extended position, in which they extend in operative orientation to define a gap for receiving fabric to be ironed between them. In this second plane, the arms are acted on by displacement means so as to close the gap between them and apply crease-removing pressure on the fabric received in said gap.

The arms in an embodiment are telescopically extensible, enabling the opposed ironing or pressing surfaces to be displaced further from the connecting body than when not extended. This arrangement permits wider garments or sheets to be received into the gap for ironing. Instead of a telescopic extending mechanism, a slider/ rail mechanism may be employed. The internal wiring and tubing is then designed to have a coiling and recoiling action depending on the degree of extension required of the arm.

To improve the suitability of the ironing apparatus of this invention as an item of particular benefit for travellers, especially business travellers, in one version the arms themselves have articulated elbow-style joints between the shoulder-like connection to the body and the heatable pads bearing the pressing surfaces. The elbow-style joints enable the arms to be folded in to reduce their footprint for packing into airline carry-on bags, for example. They also enable the opposing pressure surfaces to be brought closer to each other while remaining in mutually parallel orientation, and while the arms remain at a constant distance.

Optionally, the ironing apparatus has fitted to it a locking mechanism to stabilise the arms and pads in relation to the body when not in use. This is particularly advantageous when the apparatus is being transported, such as in a handbag or briefcase. In embodiments in which the arms are down at the sides of the body, the locking mechanism is preferably comprised of a set of mutually engageable formations on each of the arms and the body. In the case where one of the arms is fixed in an extended position, an engagement device is provided on each of the arms to the moving are to lock against the non-moving arm. This configuration enables mutual support when the device is not in use, the paddle-like pads being brought in opposition so that the pressing-surfaces are protected by facing each other.

In a further embodiment, the arms are pivotally connected to each other to move in a scissor-like manner, with the heatable pad surfaces articulatedly connected to either respective arm to be orientated substantially parallel to each other when the scissor-like arms are caused to close against the fabric to be ironed.

In an alternative embodiment, the support means comprises a generally U-shaped elongate body of flexible material, preferably resiliently so. The intermediate bow portion of the "U" defines the body that houses the control and electrical circuitry of the device. The heatable pressing surfaces are mounted proximate the ends of the "U" and are located to be opposed to each other, defining a fabric-receiving gap. By inwardly pressing the outer surfaces of the U, the user urges the pressing surfaces together to close the gap and grip the fabric for ironing, by drawing the opposed surfaces across the creases in the fabric, applying heat to remove them. In one example, the intermediate bow portion of the "U" defines an integrally-formed hand-grip. However, a hand-grip may alternatively be separately formed and attached to the bow portion.

Within the body is a space for receiving a battery of electrical cells (which may be rechargeable) for providing energy to a heating element located in a heat-giving relationship adjacent to and below the heatable pressing surface. The battery is also connected to a heating element for heating water to be heated to steam and distributed to the gap between the pressing surfaces.

A hollow zone in the body defines a space for receiving a reservoir for holding water from which steam will be generated to assist in the ironing operation. The reservoir may be located in the hand-grip portion of the body, or in a main housing located between the arms, or in one or both of the arms. The reservoir, when closed, for example by a screw cap, a clicked-in cap, a rubber seal or check valve means in the inlet, is able to be isolated from the atmosphere and be pressurised to above ambient conditions for forcing water stored in it to a steam-generating system interposed between the reservoir and a plurality of orifices in the pressing surface, from which surface steam is emitted in use. A connecting tube establishes fluid communication from the reservoir to the steam generating system, as described in further detail below.

If the water reservoir is located in the arms bearing and supporting the pressing surfaces, it is within the scope of this invention for separate reservoirs to be provided in each of the arms, especially when steam is required to be emitted from both opposing pressing surfaces. Alternatively, water may be piped in a tube from one arm to a steam-generating heatable chamber in the other. The reservoir and water reticulation system is discussed below in relation to FIG. 3.

In embodiments having the water reservoir in the main body portion, water transport from the reservoir to the zone at the rear of the ironing plate, which defines the pressing surface, is via a flexible tube of narrow bore such as would lend itself toward capillary action. To urge the water to the heating zone for steam generation, there is provided a pumping device, such as a tensioning spring with a drawstring or tension screw mechanism, to squeeze the reservoir at its circumference, either at its base or at the lid. Another example of a mechanism for discharging water from the reservoir is an air pressurising thumb-size button air pump or bulb-button pump that pressurises the reservoir with injected air. In another embodiment a tension piston mechanism is employed. Alternatively, an electrically powered submersible "micro" water pump can be employed. Preferably it is located in the reservoir and makes use of an inductively powered impeller. In a preferred embodiment, an additional supplementary air pump mechanism is provided. It works in unison with the pressing of the trigger that brings the opposed pressing surfaces together for ironing the fabric between them. For example, a button is located between the trigger and the body, so that when the human user squeezes the trigger, the air-pressurising mechanism is actuated to re-pressurise the water reservoir in readiness for the next water discharge. Providing this supplementary air-pressurising button automates air-pressurising of the reservoir for the user and means that the main air pump operating button is operable independently to cause pressurisation of the reservoir at times when actual ironing is not taking place and a steam emission is not required, such as on first starting up the ironing apparatus.

Water delivery is controllable by means of a steam control valve that is selected to permit continuous, intermittent or "per spray" or "per two sides/surfaces compression/closure" water release via a reticulating tube to a heated plate, where water drops are heated to steam within a sealed chamber located below or behind the back of the pressing surface of the pad. Alternatively, the water is fed into a perforated tube connected to a cylindrical narrow tube of a heat-conducting material, having a high heat transfer coefficient, such as copper. The tube is heated by electrical resistance heating means, such as a heating element located in heat-transferring relationship with it.

In an example of the invention, the heating element is located in the tube, so as to come into direct contact with the water entering the tube and transfer heat to the water when the element is electrically energised. In another example, the perforated tube is fitted within the heatable pad which defines the pressing surface. When the pad is heated, some of the heat is transferred to the tube (or gutter-like cavity) to steam the water. The steam then passes through the perforations through connecting channels to the orifices that introduce the steam into the ironing gap between the opposing pressing surfaces.

In embodiments having a water reservoir in one or both of the arms or located to be above and exterior to the body, water is released from the reservoir via a valve, which has been located to control access to a discharge tube. The valve may be an adjustable valve or a check valve that keeps water in the tube once it has left the reservoir—such as under gravity when the apparatus is suitably orientated during ironing activity. The valve is selected to allow water delivery by a preselectable mode, for example by continuous controlled dripping, intermittent dripping, or by movement-initiated inertia discharge. The air-pressurising or tensioned piston mechanism mentioned above may optionally be employed as a means of expelling water from the reservoir to the steam-generating chamber. A control switch for operating the valve is preferably located close to the periphery of the pressing surface so as to facilitate manual selection of the water supply mode.

In an alternative embodiment, the pressing surface is permitted to be urged backward into the arm structure when compression is applied against the opposing pressing surface, this backward urging having a checking effect on the steam generating system and causing steam to be expelled from the underlying steam generating chamber.

In a further embodiment, the pressing surface is mounted to be supported by springs located, for example, at two or more of its corners or other sites close to its periphery, these facilitating a tilting or rocking movement that provides a manner of fine adjustment or means for tracking the fabric being ironed. This enables ironing compression to be maintained despite thickness variations in the article being ironed. This is useful when ironing articles containing padding or cushioning means, flaps, pockets, proud-standing seams, joins, braiding and similar features which cause the thickness of the garment fabric structure to vary. The springs may be replaced with mechanical equivalents allowing for fabric tracking so that ironing contact is maintained between soleplate and fabric, for example, a resilient but heat-resistant padding or damping.

By releasing the pressure on the outer surfaces of the U-shaped body, the user relieves the compressive forces being exerted on the fabric, allowing it to be withdrawn from the gap.

In embodiments wherein the body contains a battery of rechargeable cells, the apparatus includes a base plate providing a charger for connecting with the battery.

A preferred embodiment of the invention is described now with reference now to FIG. 1 (perspective view) in which an ironing apparatus, designated generally by the number 10, has a body portion 12 with a base portion 14. A first heatable fabric-pressing surface 18 is mounted to be supported on a first arm 20 by means of a circular joint 23, associated with a sliding rail 21, to permit sliding displacement of pressing surface 18 in the direction of lateral extension of arm 20 in a plane substantially parallel with the plane of a second pressing surface 26, when the surfaces are brought together to lie adjacent to and almost abutting each other.

Arm 20 is pivotally attached to the body 12 at connecting joint 22. When pressure is exerted by the user on hand-grip portion 24, an articulating mechanism (not shown) causes arm 20 and surface 18 to be urged towards opposed second pressing surface 26, which is similarly mounted to a support portion 38, which itself is slidably connected to fixed arm 28, to enable pressing surface 26 be located opposite corresponding surface 18. In this embodiment, arm 28 is manufactured to be integral with body portion 12.

Essential wiring, fluid-carrying tubing and a main heating element are installed within the fixed arm 28. The opposing arm 20, being significantly lighter than fixed arm 28, is used as the support means for the relatively mobile compressing member, being the plate with pressing surface 18. Optionally, surface 18 is provided with or without one or both of heating and steaming functions. In the case of its not being provided with heating, it will receive and absorb heat, during ironing, from the opposed heated surface 26, via steam impingement, radiation and conductance, either through direct contact or via the fabric being ironed.

Mounted within a recess in the pivotally movable arm 20 is a water reservoir 16 (which has an inlet to enable filling, but is not shown). The reservoir is in fluid communication with a tube leading to a chamber located behind the steam emitting orifices (not visible) in surface 18. Similarly, a water reservoir (not shown in FIG. 1) is located in support portion 38 connected to arm 28, and is in fluid communication with a chamber 32 (see FIG. 2) defined behind the orifices 40, from which steam, generated by the heating device in the arm, is emitted, to contact the fabric being ironed in use.

Figure 2:
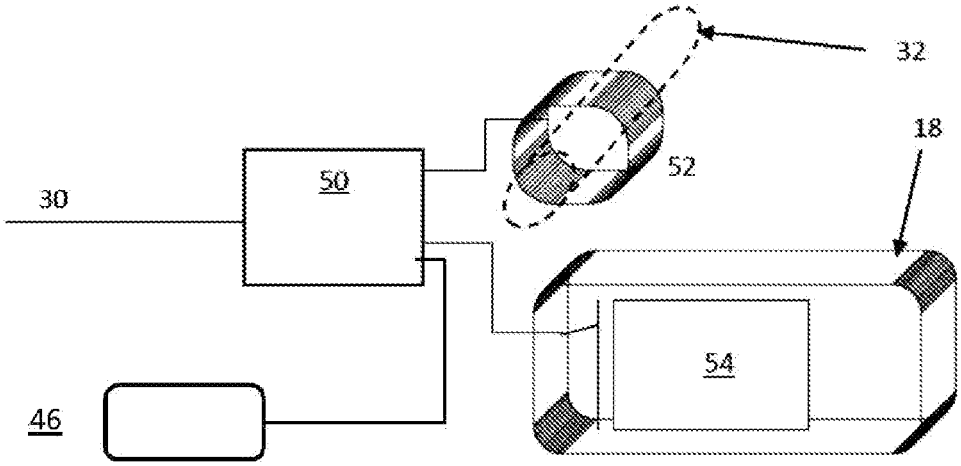
FIG. 2 is a schematic diagram of the heating system of the invention.
Figure 2:
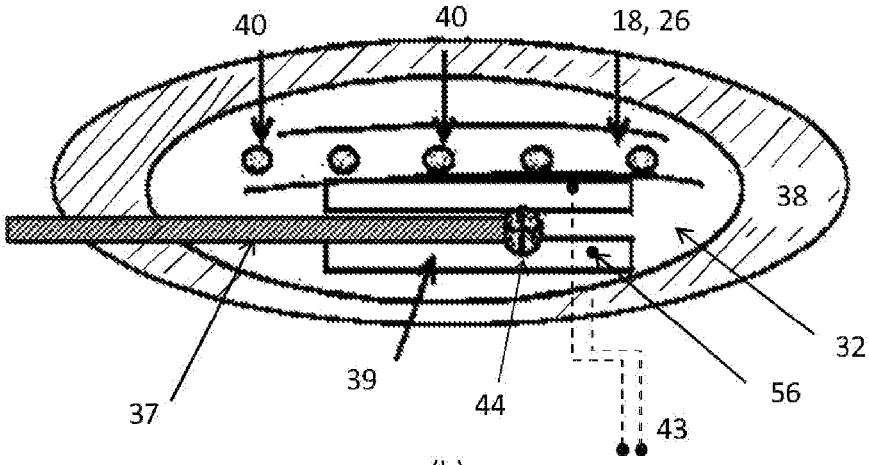

Electric power, for converting into heat for steam generation, is delivered to body 12 via cord 30, which is connectible to an external mains supply or other power source. Cord 30 is connected inside the body to a switch panel 50 as shown in FIG. 2. From panel 50, power is distributed to a heating element 52, which is in heating relationship with a tube 32. Tube 32 provides a means of fluid communication from the water reservoir 16 to a plurality of orifices located on surface 18. Water entering tube 32 from reservoir 16 is heated by heating element 52 to form steam. The steam passes along tube 32 to the orifices and is introduced by being emitted into the gap and on to the fabric being ironed. In this example, the tube itself defines the steam chamber.

Electrical energy distributed to heating element 54 is used for heating the surface 18. Similarly, a further heating element (see FIG. 2(*b*)) associated with surface 26 provides additional heat for the crease-removal process on fabric being passed through the gap in use. In other embodiments, a single heating element heats both the pressing surface and the steam chamber. In an alternative configuration of the apparatus, the steam chamber not only provides steam for expulsion on to the fabric being ironed, but is also configured to transfer heat to the pressing surface. This allows heating element 54 to be switched off when an operating temperature producing sufficient steam is reached, or to be dispensed with entirely, leaving all heating to be achieved via element 52.

The electrical power supply to the heating elements mentioned above is managed by means of a combined depressible on/off switch and temperature-controlling thermostat dial 34 (see FIG. 1), connected via the switching control panel 50 to be in circuit with the heating elements. A button 35, when depressed by a user, causes steam to be emitted by means of an air pumping mechanism described more fully below with reference to FIG. 3. A further button 36 manages steam delivery by actuating a mechanism also described in FIG. 3. An LCD display panel 46 connected to a microprocessor in switch panel 50 provides an output of pressing-surface temperature and steam emission data derived from thermocouples located behind surfaces 18, 26 and in chamber tube 32.

In FIG. 2(*b*), the arrangement for delivering steam to the plates having pressing surfaces 18, 26 is illustrated schematically as a section taken along line A-A' in FIG. 1. Here steam-emitting orifices 40, shown to be located in the upper half of the pressing surfaces, are in fluid communication with chamber 32, which is fed with water via delivery tube 37. Chamber 32 is shown bounded by peripheral support portion 38, to which the plates having pressing surfaces 18, 26 are sealingly mounted. Electrically heated elements (see 52 in FIG. 2(*a*)), contained within electrically-insulated, but heat-conducting pads 39, and connecting to terminals 56, serve to heat tube 37 and chamber 32, so that entering water heats and expands to steam and is forced out via the orifices. Electrical circuitry for supplying heating power to pads 39 is denoted by the numeral 43. This interfaces with control switch panel 50, referred to above in relation to FIG. 2(*a*). A one-way pressure-sensitive relief valve 44 controls the egress of steam from the chamber. Puffs of steam are emitted when the internal pressure achieves a pre-selectable value. When the pressure drops to a replenishment level, the valve closes, so that continued heating causes steam to build up again in readiness for the next batch release.

Figure 3:
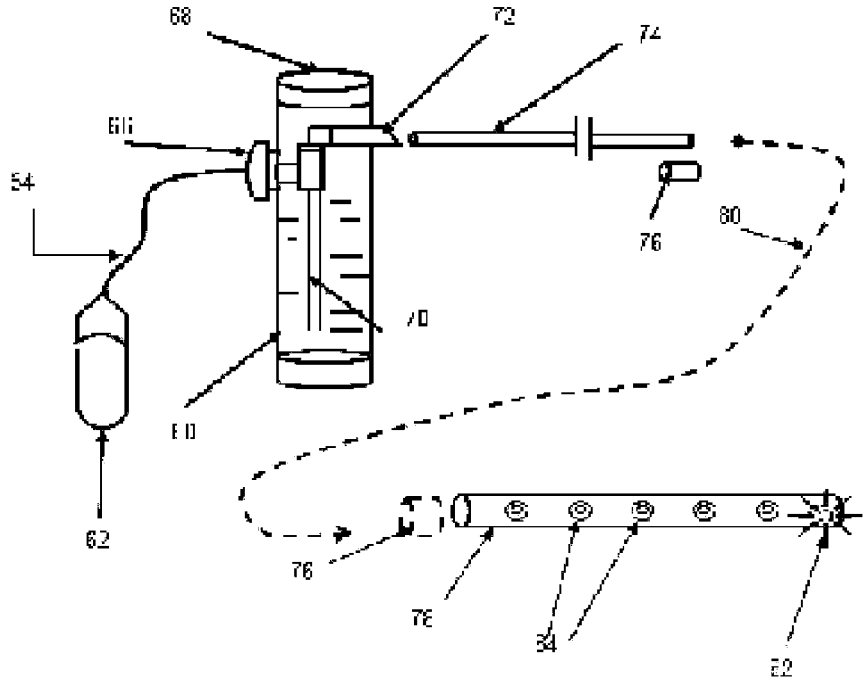
FIG. 3 is a schematic diagram of a reservoir and steam generating system included in the invention, according to a preferred embodiment.

Referring now to FIG. 3, there is shown, in schematic form, water reservoir 60 and an associated steam delivery system, which supplies steam to the orifices 40 in FIG. 1. As discussed above, reservoir 60 may be housed in the body or in one of the arms (corresponding to reservoir 16 in FIG. 1). A second reservoir may be housed in the other arm, if steam is required to be fed to both pressing surfaces. Of course, water may be reticulated from a reservoir in one arm, via tubing across to the other arm for supplying a steam chamber in that destination arm.

Referring still to FIG. 3, an external (to reservoir 60) button-actuated air pump device 62 (of conventional known design) pressurises the interior of reservoir 60 via tube 64 leading to inlet connecting valve 66. Lid 68 secured to the reservoir can be removed for filling purposes and provides an airtight seal enabling pressurisation of the interior to a sufficient level for expelling water therein to the downstream steam-generating chamber (not shown). Water is expelled from reservoir 60 via take-up tube 70 leading to nozzle 72, which feeds into discharge tube 74, which in turn is connected by means of connector 76 to the electrically heated steam generating tube 78, as indicated by dashed line 80. Steam tube 78 has in it an electrical heating element (not shown) which provides direct heating to water drops within the tube. The element is connected to an electrical supply at connector 82. Steam generated in the tube 78 is expelled through perforations 84, which are in fluid communication with the pressing surface orifices 40 in FIG. 1.

Figure 4:
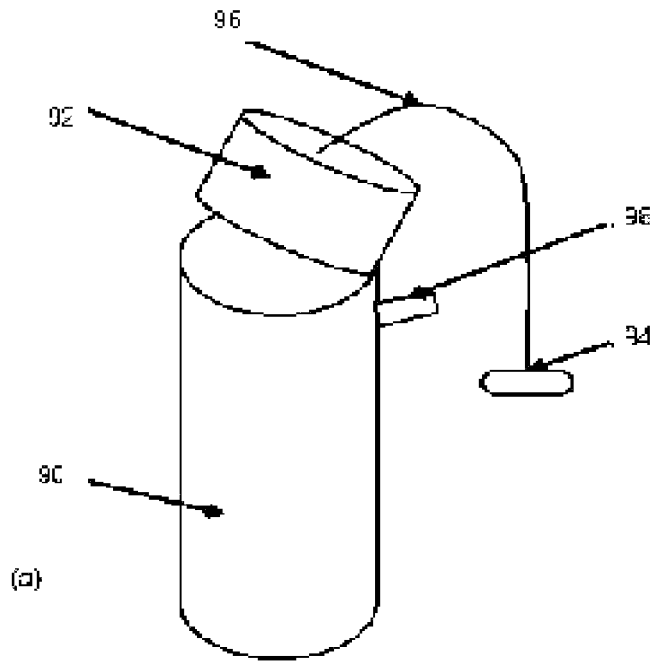
FIG. 4 is a schematic side view of a pressurised water reservoir of the invention with cap removed in (a) for filling and with pressure applied to the contents in (b).
Figure 4:
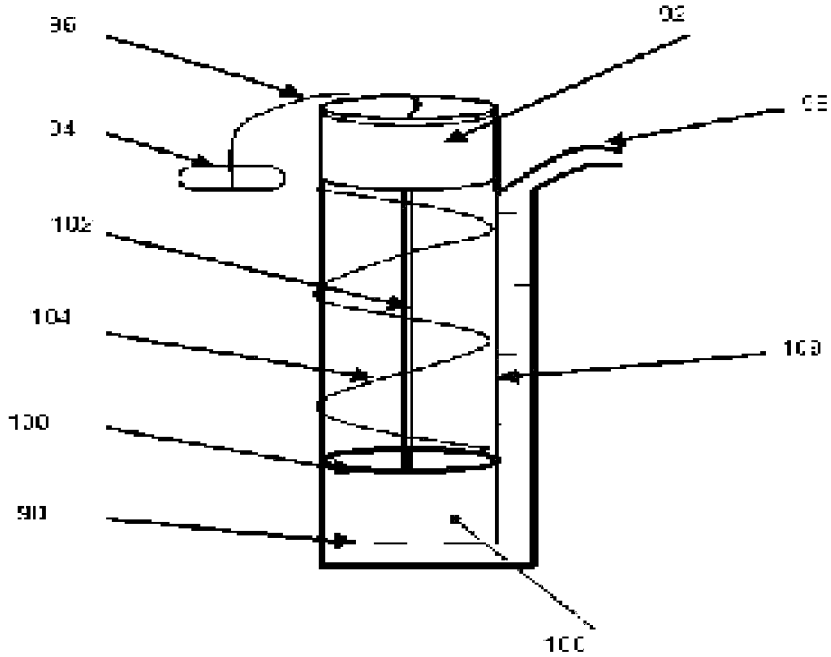

An alternative to the device of FIG. 3 is illustrated in FIGS. 4(*a*) and (b). In FIG. 4(*a*), water reservoir 90 has removable sealing cap 92, through which is connected pulling knob 94 connected by a tensioning drawstring 96. When knob 94 is pulled to extract drawstring 96 from cap 92, it draws into the cap a tensioning spring assembly comprising the spring, rod and disc, which are shown as 104, 102 and 100 respectively in FIG. 4(*b*). When the spring assembly has been withdrawn into cap 92, the cap is removed to enable replenishment of reservoir 90.

In FIG. 4(*b*), reservoir 90 is shown with cap 92 in sealing engagement, and pressure disc 100, connected via rod 102 to drawstring 96, under tension from biasing spring 104, exerting pressure on the surface of the water 106 contained in the reservoir. This biasing pressure forces water up the channel 108 to the outlet 98.

Figure 5:
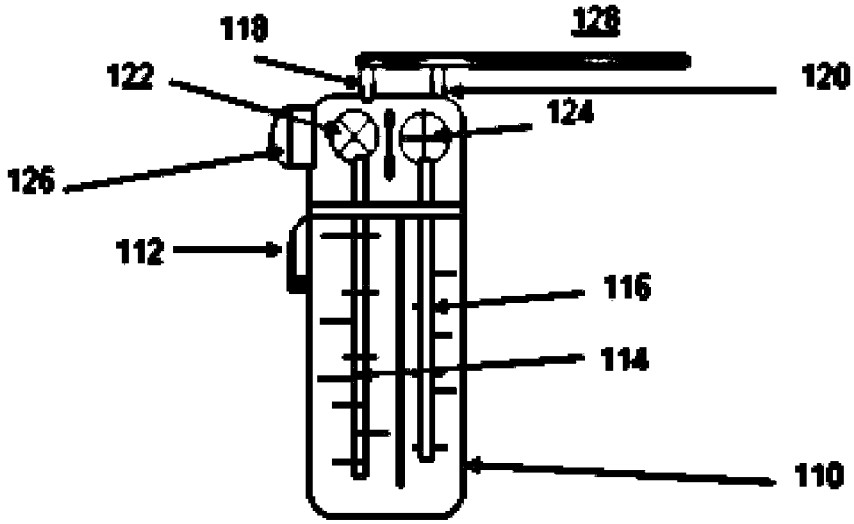
FIG. 5 is a schematic side view of an alternative embodiment of the steam producing system used in the invention.

A further example of a water supply system that is used in this invention is illustrated in FIG. 5. This system is preferred for fitting into the body rather than into either of the arms of the iron. It has a reservoir 110 that may be integrated within the body structure, or may be removably attached for temporary detachment for ease of refilling through a filling window or mini-gate 112.

A thumb-operated air-pump button valve 126 assists in enabling pressurisation of the reservoir so that water is expelled through internal tubes 114, 116 leading to respective outlet connectors 118, 120. These connectors are connected via flexible tube 128 leading to the steam-generating chambers (not shown), located in the respective support arms, which bear the heated pressing pads. A supplementary air pressurisation pump-button is located in the trigger mechanism (not shown) that brings the pressing-surfaces together for ironing, so that whenever the trigger is squeezed, the reservoir is re-pressurised.

A button 122, when pressed by the user, causes a surge of water to the steam generating chamber. The water is rapidly heated to steam, resulting in a steam spray being ejected from the steam generating chamber into the ironing gap.

In comparison to button 122, button 124 is an on/off toggle switch that, when in open position, causes continuous dripping of water to the steam generating chamber for a substantially continuous steam stream to be emitted to the fabric-receiving gap.

Optionally, chamber 110 is segregated into two compartments, with one being dedicated to the intermittent steam-emitting function and the other to the continuous steam supply.

Figure 6:
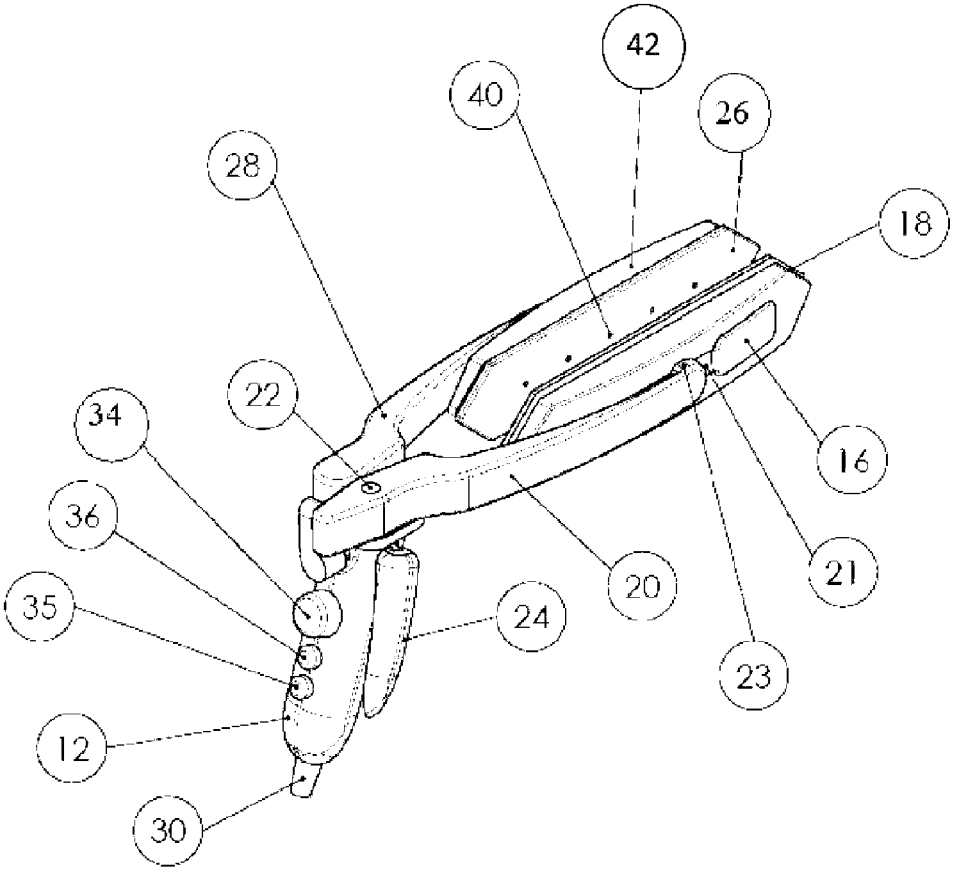
FIG. 6 is a perspective view a second embodiment of the ironing apparatus of this invention.

The embodiment of the apparatus of the invention illustrated in FIG. 6 is similar to that of FIG. 1 and carries like numbering for like parts. In FIG. 6 the difference lies in the trigger 24 being located on the right-hand side of the pistol grip body 12. This arrangement is found to suit left handed users better than the embodiment of FIG. 1. It will be apparent to the astute reader, that the configuration in either embodiment is easily able to be redesigned for a user favouring the other hand.

As in FIG. 1, it is right side arm 20 that is displaceable relative to the body, while left arm 28 is rigidly fixed to the body. Providing support for surface 26 is backing portion 42, in which is contained a steam-generating chamber, from which steam is fed to be emitted from orifices 40.

Figure 7:
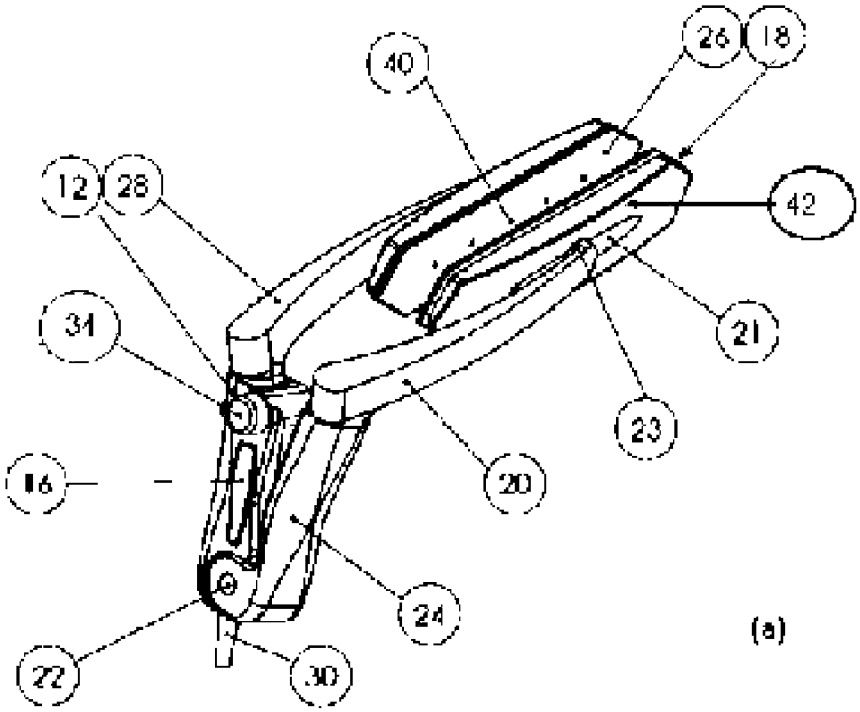
FIG. 7 is a perspective view of an alternative embodiment of the invention.
Figure 7:
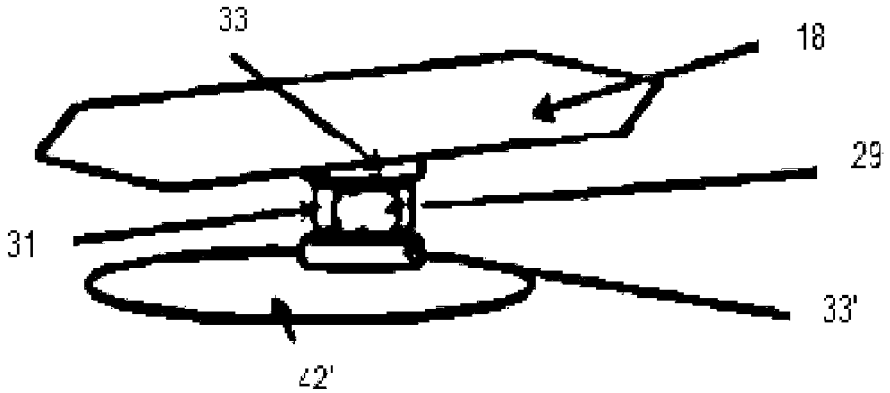

In FIG. 7, arm 28 is integrally formed with body 12 to remain in mutually fixed orientation. Body 12 includes a recess in its housing for receiving reservoir 16. Arm 20 is relatively moveable in relation to body 12 and arm 28. It is pivotally connected to body 12 by means of articulated joint 22, located at the foot of the body, at the end at which electrical cord 30 enters body 12. It will be observed that trigger mechanism 24 is located on the outside of the moveable arm 20. Attention is also drawn to backing pad 42', providing backing to pressing surface 18. In FIG. 7(*b*) detail of the mounting arrangement for enabling surface 18 to track fabric of varying thickness is shown. A ball 29 is enclosed in a spring 31, which is secured to the back of surface 18 and support plate 42' at first and second fixing rings 33 and 33'. This arrangement causes surface 18 to be biased towards opposing pressing-surface 26 despite discontinuities in the thickness of the fabric being ironed, such as arising from variations in the shape or thickness from pockets, padding, joins, collars, cuffs, flaps and like. At the same time, the presence of ball 29 enables tilting of the pressing surface relative to support plate 42', so that the irregularities and discontinuities in the fabric do not disrupt ironing action.

Figure 8:
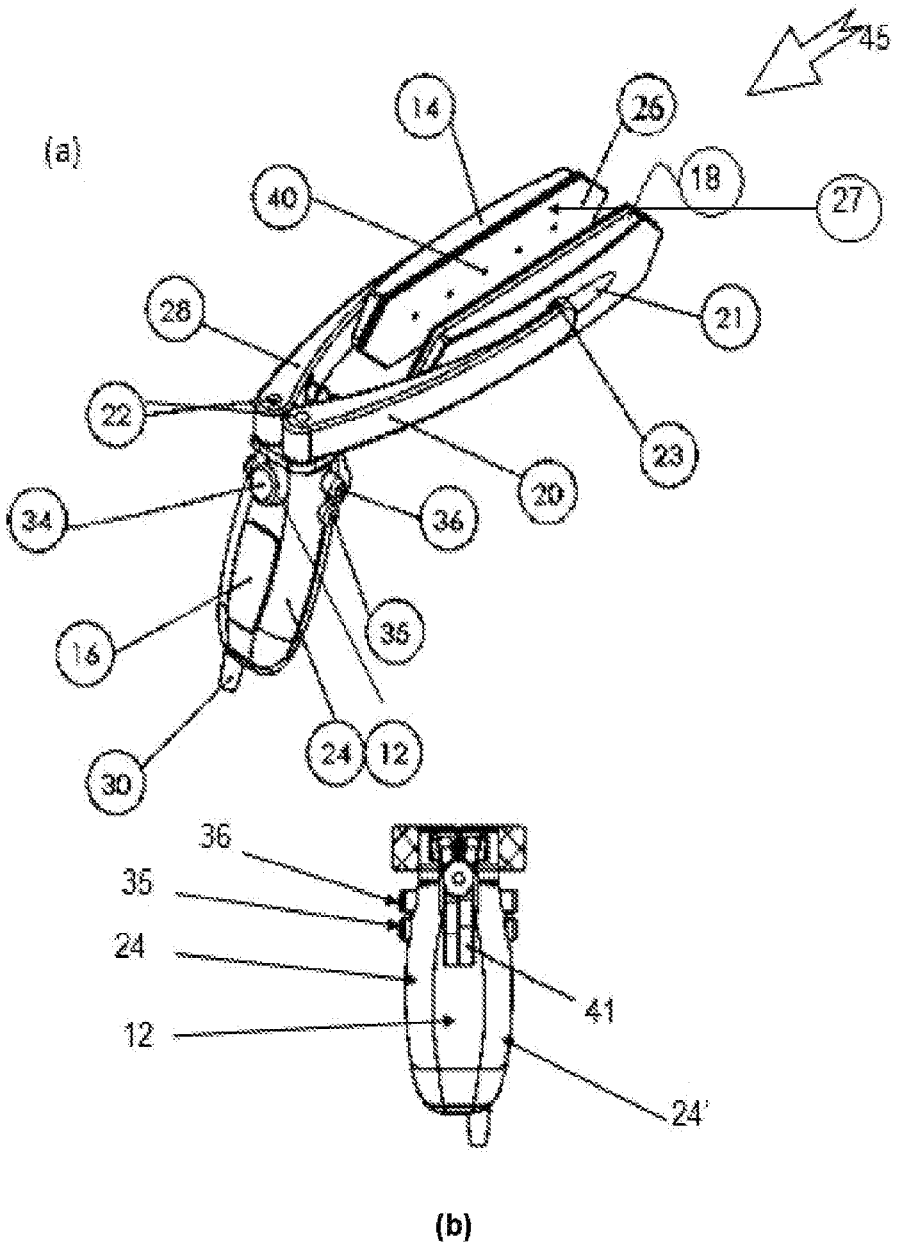
FIG. 8 is a perspective view of a further example of the invention.

Referring to the embodiment in FIG. 8, it will be seen that like parts from FIGS. 1, 6 and 7 are given like numbering. The two arms 20, 28 are both pivotally connected to the body 12 by means of pivot connections 22. These enable the arms to be spread and brought together by operating trigger portions 24, which flank body-housed reservoir 16. In this embodiment, the gap 27, defined between pressing surfaces 18 and 26 is normally closed, but is opened by squeezing twin trigger plates 24 and 24', flanking the body 12, as shown in FIG. 8(*b*). The squeezing action is translated into lateral inward movement of arms 20, 28 and surfaces 18, 26 toward each other.

Reservoir 16 is located within body 12, and valve operating buttons 35 and 36 are located on the right hand side, just below the pivot connection 22 for arm 20, providing the facility for the user to manage the ironing temperature according to the characteristics of the fabric being ironed, and the emission of steam.

The backing pad to pressing surface 18 is connected to arm 20 by means of circular angulation joint 23 which is slidably engaged with sliding rail 21, to allow relative lateral movement, of the pressing surface 18 in relation to arm 20. In this embodiment, the reservoir 16 is located centrally and relatively low down on the hand-grip portion defined by body 12.

FIG. 8(*b*) presents a front-on view of the ironing apparatus, looking in the direction of arrow 45. Visible in this view are parts 41 of the trigger mechanism portion 24. On each side of the body and located on the trigger portions 24, 24 are pairs of symmetrically accessible control switches 35, 36, as also seen in FIG. 8(*a*).

Figure 9:
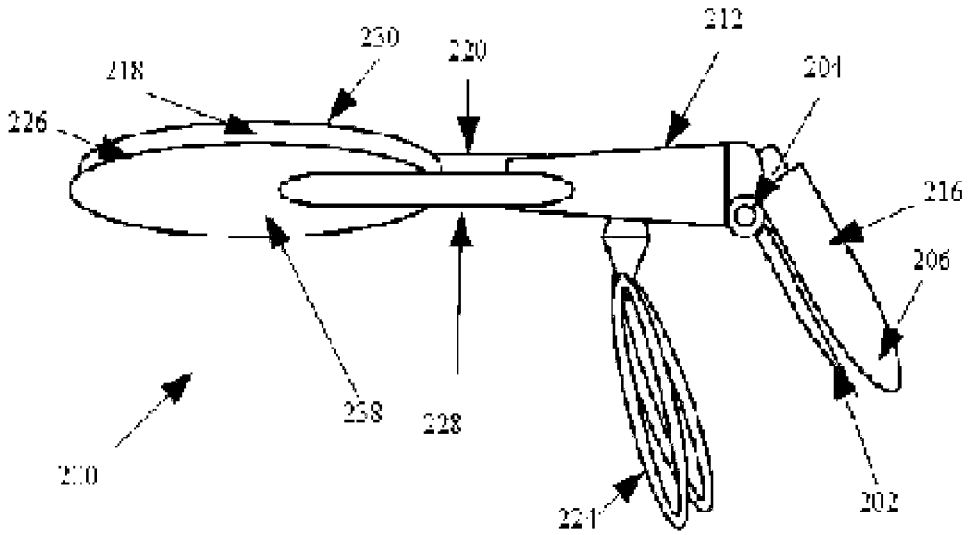
FIG. 9 illustrates in perspective and partially exploded views of an alternative embodiment of the invention.
Figure 9:
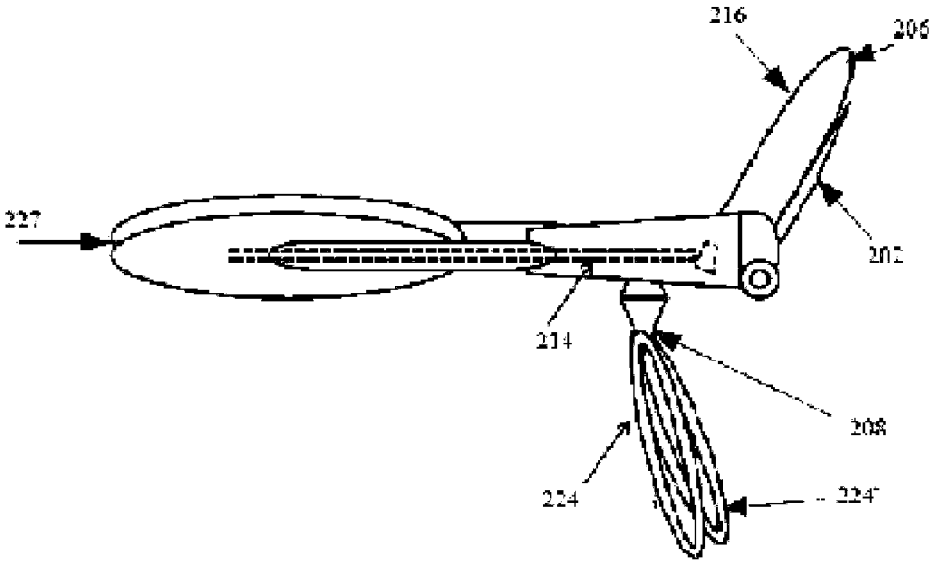
Figure 9:
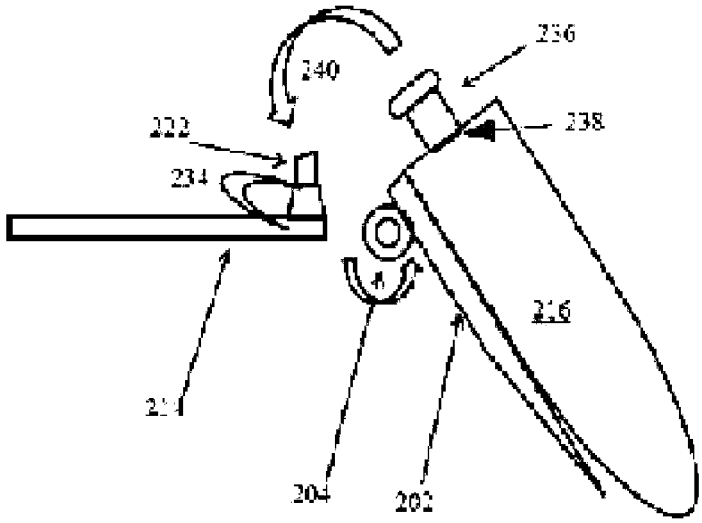

FIG. 9 illustrates an alternative embodiment of the invention 200, in which a reservoir 216 is mounted onto a support plate 202 to be supported externally to body 212. Support plate 202 is pivotally connected to body 212 at pivot connector 204. Arms 220 and 228 extend from body 212 and are movably connected to backing pads 230 and 238 to which heatable pressing surfaces 218 and 226 are fixed.

While not in operation, as shown in FIG. 9(*a*), reservoir 216 is supported at a lowered, resting position generally below the body, so that water in the reservoir collects at the apical end 206. The apparatus 200 is configured to enable reservoir 216 to be raised to stand proud of and above the body when the apparatus is in operating mode, as shown in FIG. 9(*b*).

The raising of the reservoir to an erect position in which the water inside then has a positive hydraulic head in relation to the pressing surfaces, thereby facilitating water supply to the steam generating chamber. The elevating of the reservoir by support plate 202 is accomplished by the user operating the actuating mechanism to urge the backing plates supporting opposed pressing surfaces 218, 226 towards each other, thereby narrowing the fabric receiving gap 227.

In this embodiment, the actuating mechanism comprises two gripping rings 224 and 224, located below body 212. When these are squeezed together in a scissor-like action by the user's thumb and index and middle finger, the work this motion produces is translated through mechanical linkage 208 to cause support plate 202 via pivot connection 204 to raise reservoir 216 into a water-delivering position in which water is able to flow through internal tube 214 to be heated to steam and emitted through the orifices in pressing-surfaces 218 and 226. Tube 214 has a connecting piece 222 fitted to it and is twist-locked in place, as suggested by arrow 234.

When the reservoir is lowered to its first, resting position, the flow of water is interrupted. This is described with reference to FIG. 9(*c*) in which there is shown an isolating valve 236 fitted at reservoir outlet 238. When the reservoir is tipped up to be inverted to its erect, operational position, valve 236 engages with connecting piece 222 attached to tube 214, as shown by arrow 240. The end of piece 222 penetrates valve 236, causing it to be opened and establish fluid communication between reservoir and tube, allowing water to be delivered for steam generation, by heating elements (not shown). When the human user releases the gripping rings 224, 224, the reservoir is caused by a spring biasing element in the pivot connection to return to its resting (lowered) position, thereby disengaging tube connector 222 from valve 236, so that valve 236 closes and water ceases to be released from the reservoir.

Figure 10:
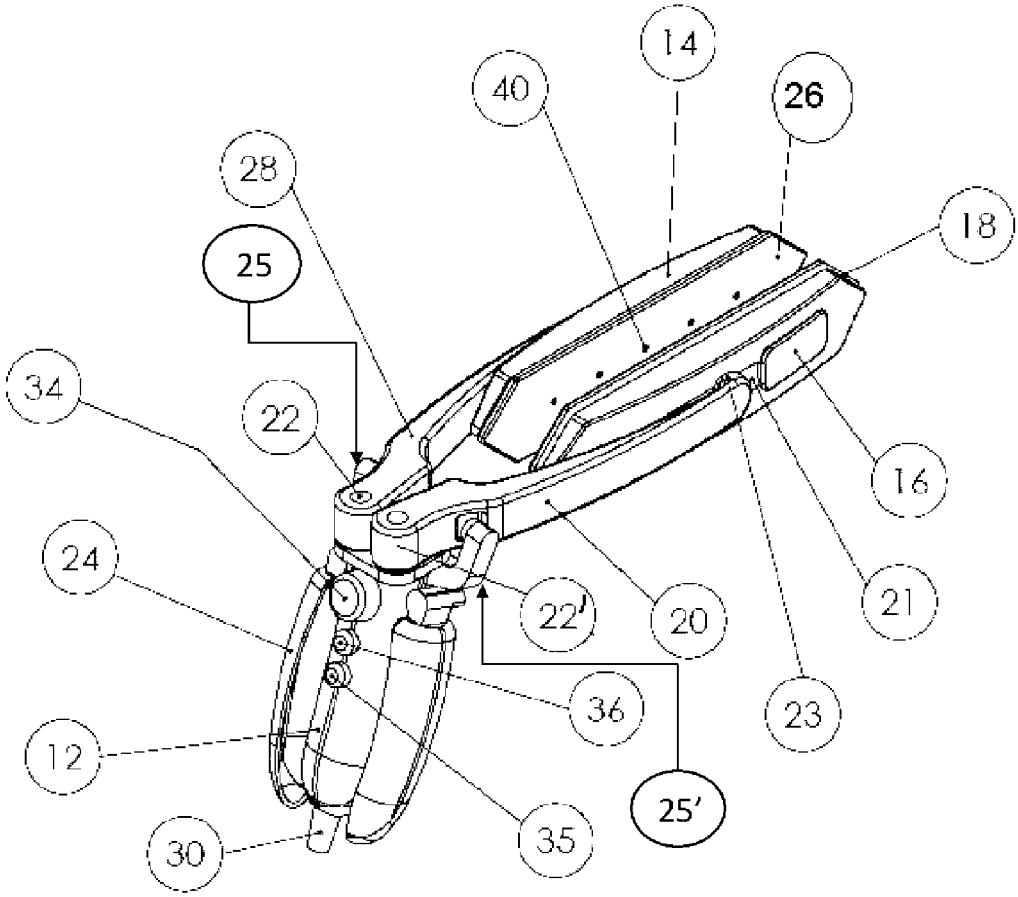
FIG. 10 is a perspective view of yet another embodiment of the invention.

Referring now to FIG. 10, there is seen another embodiment of the invention wherein the two arms 20, 28 are again both pivotally attached to body 12. This time reservoir 16 is located in the arm 20, leaving space in the central rear portion of the hand-grip portion of body 12 for the control buttons 35, 36 to be located.

When the apparatus shown in the embodiment of FIG. 10 is not in use, the articulated joints 25 and 25' allow arms 20, 28 to be folded downward into alignment with and alongside body portion 12 for ease of packing and volume minimisation.

Typically the assembly is about 135 mm high and the arms about 210 mm long, with the paddle-like sections 14 that support the actual heated pressing pads about 160 mm long and about 40 mm high. In the open position, the distance between the facing heated pressing surfaces is in the range 50 mm to 60 mm. These dimensions render the apparatus particularly suitable for packing and use by travellers. Indeed, mini-versions that take up even less volume are fabricated for hand-bagging.

Optionally, the ironing apparatus includes a hanger that supports and presents the clothing being ironed in a tensioned, stable and convenient manner for ironing by means of the previously described dual pressing surface apparatus of this embodiment. The hanger is found to improve ironing efficiency and helps to avoid issues of fabric being floppy or loose during ironing. The hanger comprises at least two arm members connected at an articulated joint and that can be extended in different directions to bear upon the clothing being ironed, so as to place it under a sufficient degree of tension that it does not readily crease under the friction of the iron soleplate being passed over it.

It should be noted that the hanger is not needed when ironing trousers for instance, as trousers can easily be ironed using the apparatus of the invention while hanging on an ordinary trousers or pants hanger. The proposed novel hanger is provided either in a collapsible and expandable form, or in a form for being folded and unfolded with a rail-like bar that allows peripheral leverage to slide in and out, so as to fit with the width of the fabric being ironed or to drop down to fit with the length. The hanger is intended to enable a simple ironing technique, being lightweight and easy to use. In a preferred embodiment, the arms are telescopically extensible with ratchet-type articulated connections allowing positioning to be maintained once set. The angle of setting need not be perpendicular to the elongate axis of the body: It may be greater or less than 90° from the said axis, depending on the preference of the user.

Figure 11:
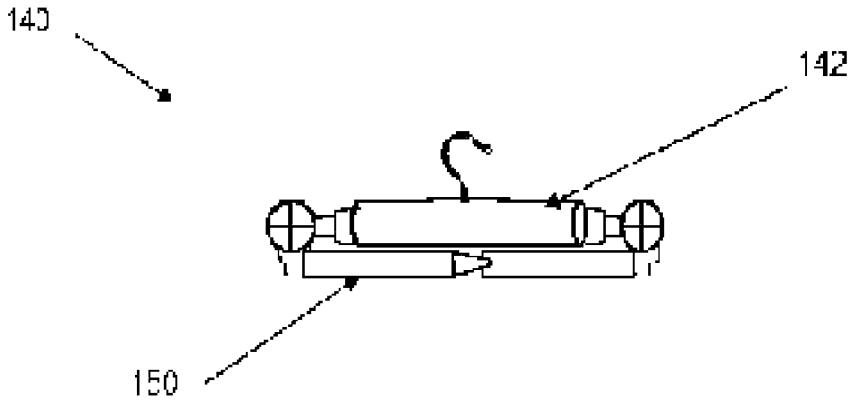
FIG. 11 is a side view of a hanger according to an optional item of the invention, in operative and storage configurations.
Figure 11:
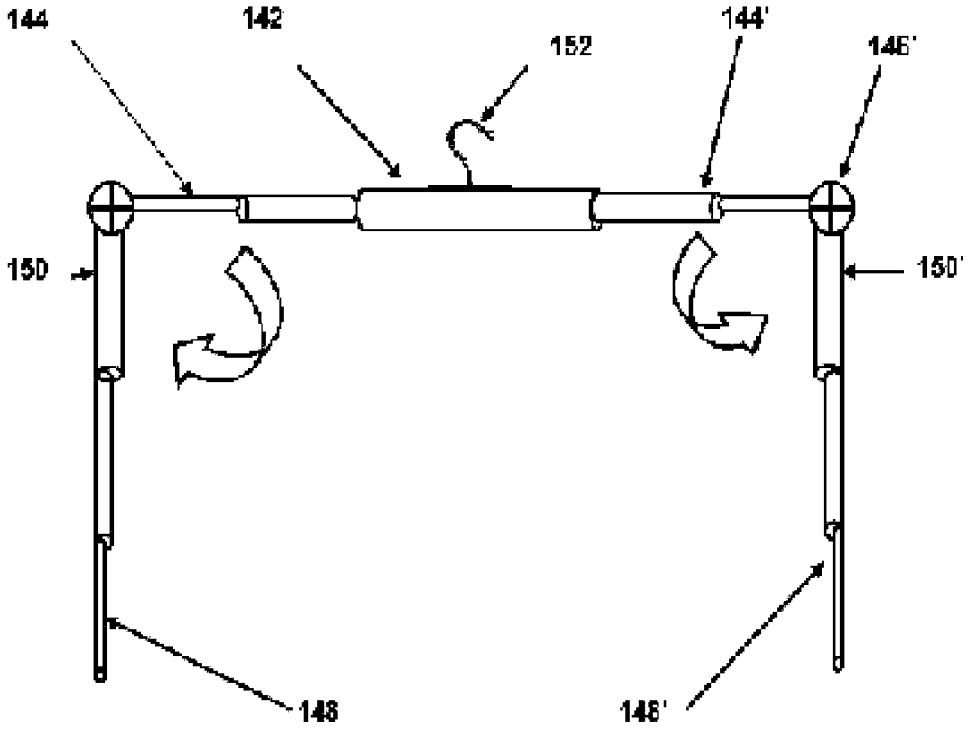

An embodiment of the hanger of this invention is illustrated in FIG. 11.

In FIG. 11(*a*), the hanger 140 is shown in collapsed form in which it is easily packed and carried, such as in a small travel bag or even a handbag. In (b), the hanger is shown in front view with its horizontal shoulders 144, 144' in extended, operative configuration.

The hanger has a cylindrical housing 142, into which its pair of segmented and extensible shoulders 144 and 144' are telescopically sheathed for storage, as shown in FIG. 11(*a*). Telescopically-segmented arms 148, 148' are folded into proximal segments 150, 150' for storage below the housing 142.

Protruding from housing 142 is a pair of opposed articulated joints 146, 146', connecting the shoulders to a pair of arms 148, 148'. The arms 148, 148' are extensible from their proximal segments 150, 150' to depend generally perpendicularly in relation to the shoulders 144, 144' from the joints 146, 146'. However, because of articulated joints 146, 146' the angle of extension between arms and shoulders is conveniently in the range from 30° to 150°. This range of angles enables the arms to be folded to an acute angle suitable for conveniently tensioning panels of garments such as found in the sleeves of tee-shirts.

Because of the telescopically-connected segments of the shoulders 144 and arms 148, the hanger can be sized to place under suitable tension for ironing the cloth panels of a wide range of garment shapes and sizes.

Optional foot portions (not shown) may be provided to be pivotally joined to the arms 148, 148 at their distal ends. The foot portions serve as additional means of stabilising a garment hanging on the hanger. They also provide a gripping element for use as a handle for pushing the telescopic arm segments into their sheath segment member, 150.

The hanger is of course equipped with a crook 152 for hanging to a rail or similar support (not shown).

Figure 12:
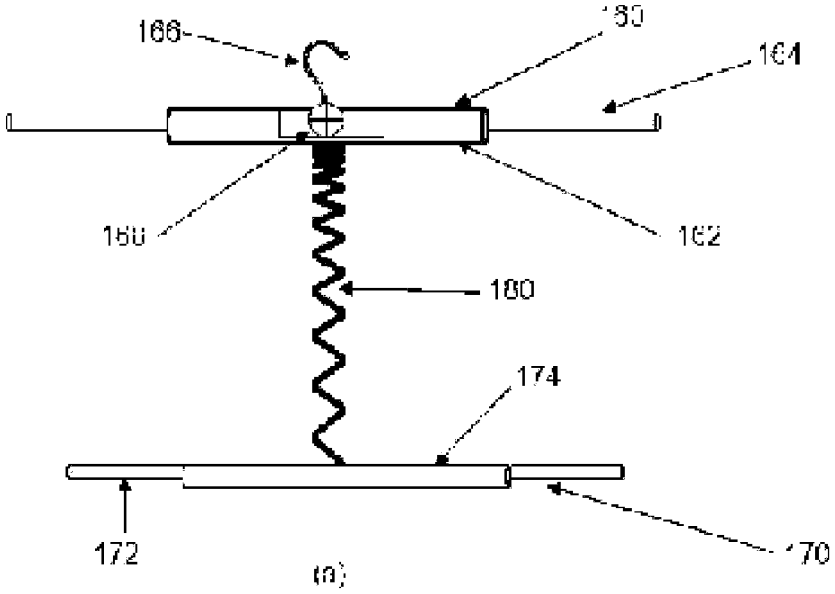
FIG. 12 is a side view of a second example of a hanger according to an optional item of the invention, in operative and storage configurations.
Figure 12:
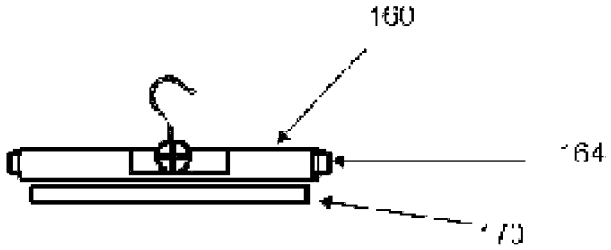

Referring to FIG. 12, there is shown in (a) a further embodiment of the extensible hanger of the optional aspect of the invention. This example of the hanger comprises substantially parallel upper 160 and lower 170 elongate members linked by an extensible and retractable articulated connecting arm 180. The upper member 160 is equivalent to the shoulders 144, 144' in FIG. 10(*b*) and is made up of a housing 162 from which extending horizontal portions 164 may be drawn for use and then pushed back into the housing for storage or transportation. There is a hanging crook 166, below which is an articulated pivotal connector 168 for connecting the housing 162 to the connecting arm 180. At the lower end of the arm 180 is a lower tensioning member 170 comprising a housing 174 connected to the arm 180, and extensible opposite members 172 which are pushed into the housing 174 when not needed.

Figure 13:
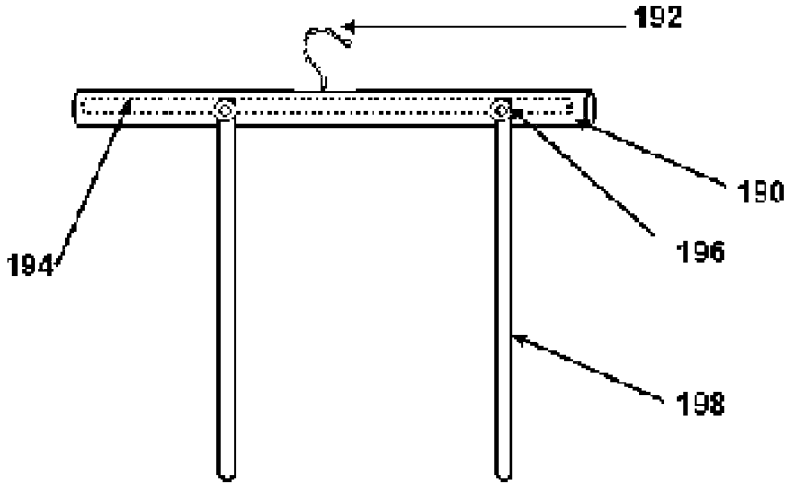
FIG. 13 is a side view of a third example of a hanger according to an optional item of the invention, in operative and storage configurations.
Figure 13:
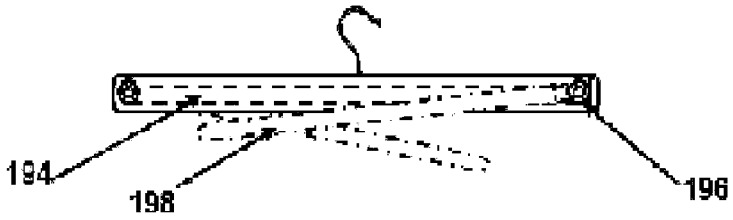

In the hanger exemplified in FIG. 13, a cylindrical housing 190 depends substantially horizontally from a hanging crook 192. The housing 190 has a hollow interior in which is placed a friction rail 194 on which roller connectors 196, 196' are able to slide under manually applied transverse force, when applied to depending elongate arm members 198, 198'. The arm members 198 are pivotally connected to the roller connectors 196 by a ratchet mechanism that enables them to maintain an angle selected in the range −50° to +50° from the vertical, as determined in relation to substantially horizontal shoulder-like member 190.

In FIG. 13(*b*), the hanger of FIG. 13(*a*) is shown with the arm members 198, 198', depicted by means of dashed lines, being folded up into housing 190, in preparation for storage. Optionally, stabilising clips (not shown) are provided for stabilising the arm members against movement during ironing. Pegs may be included for stabilising the garment being ironed against movement caused by the friction of the pressing surfaces of the iron while hanging.

In a further embodiment of the ironing apparatus of the invention, the support means for the opposed dual pressing surfaces comprises two pivotally connected arms in scissor configuration, wherein the operation of the arms in scissor fashion brings the opposing heating surfaces mounted to the corresponding ends of the arms together into abutment.

The dual pressing surface configuration of this invention is able to perform several functions that prior devices are unable to achieve, namely that of simultaneous ironing, steaming and compressing. The body is made largely of lightweight and thermally resistant plastics materials.

The provision of dual pressing surfaces extensible from a hand-held iron body realizes considerable functional advantages over the "freely" held single soleplate iron, which requires a separate, non-heated support for the fabric being ironed, such support coming in the form of an ironing board.

The location of the water reservoir away from its traditional position immediately behind the heat plate in a classical iron advantageously distinguishes this invention from conventional known apparatus.

The ironing apparatus of the invention is able to be fabricated so that the gap between the opposed pressing surfaces is either normally open or normally closed. If the default positioning is normally open, actuation of the gripping trigger such as by compression or squeezing action causes the gap to be closed into an ironing configuration. Typically, the normally open gap is in the range from 30 mm to 70 mm, preferably from 50 mm to 60 mm. If the default positioning is normally closed, actuation of the gripping trigger causes the gap to be increased so that fabric to be ironed can be received into it.

It will be appreciated that the apparatus of the invention enables the saving of time, effort and energy because of its fundamental dual sided heating and pressing action. It is found to be easy and quick to unpack and apply the apparatus in a simplified ironing process, when compared with the "traditional" steam iron in common use.

These embodiments merely illustrate particular examples of the invention and the method of using it in ironing textile items such as clothing, towels, sheets, tablecloths and curtains. With the insight gained from this disclosure, the person skilled in the art is well placed to discern further embodiments by means of which to put the claimed invention into practice.

I claim:

1. Ironing apparatus comprising:

opposable first and second fabric-pressing surfaces;

support means comprising a body and first and second arm members extending therefrom;

mounting means for mounting the pressing surfaces to said respective arm membersI; and orienting means for causing tracking of said pressing surfaces to seek to assume a substantially parallel and opposed relative mutual orientation in use, said orienting means comprising features selected from:

tilt-enabling means for allowing the pressing surfaced to tilt axially and transversely in relation to said arm to which it is mounted and causing adjustment of the gap to accommodate variation in thickness of an article being ironed;

ball-mounting means disposed between said pressing surface and said arm;

biasing means located between one or both of said pressing surfaces and said arm to which it is mounted; and combinations thereof;

wherein said body comprises urging means operable to urge said first surface toward said second surface so that said pressing surfaces are in opposed relationship, whereby:

in use, a fabric-receiving gap is defined between said surfaces for receiving fabric to be ironed;

and the gap is narrowed from a first, fabric-receiving width, to a second, fabric-compressing width effective for exerting crease-reducing pressure on fabric located in the gap, while permitting relative traversing movement between said surfaces and the fabric.

2. The apparatus of claim 1, wherein the interrelationships between said arm members and said body are selected from:

said first arm member is movably connected to said body, and said second arm member is integrally formed with said body to extend therefrom in fixed orientation;

articulated connection means movably connects least one of said first and second arm members to said body;

at least one of said first and second arm members comprises first and second articulatedly interconnected arm portions, wherein each first arm portion is proximate said body and located between said body and said articulatedly interconnected second portion, with said pressing surface mounted on said second portion;

and combinations thereof.

3. The apparatus of claim 1, further comprising heating means for heating at least one of said surfaces, said heating means selected from:

electrical heating means;

steam generating means;

steam-emitting means for introducing steam into the gap, said steam-emitting means comprising orifices associated with at least one of the pressing surfaces;

and combinations thereof.

4. The apparatus of claim 3, comprising:

steam-generating means comprising a reservoir adapted for holding water at a pressure exceeding ambient conditions, water heating means; and fluid communication means between said reservoir, said water heating means, and said steam-emitting orifices.

5. The apparatus of claim 4, further comprising features selected from:

said reservoir is adapted to withstand pressure sufficient to expel water from said reservoir to reach the water heating means;

said water-heating means comprises a heatable chamber for receiving water expelled from said reservoir;

said chamber is heatable by means of an electric heating element;

at least one pressing surface is in thermal communication with, for receiving heat from, said chamber;

said chamber is configured to have an inlet for admitting steam or water to said chamber, with said orifices located above the level of said inlet;

said reservoir is contained within said body; and combinations thereof.

6. The apparatus claim 4, further comprising positioning means for moving said reservoir from a first, water-retaining position to a second, water-delivering position.

7. The apparatus of claim 6, wherein said positioning means comprises an actuating mechanism that moves said reservoir to said second position contemporaneously with said pressing surfaces being urged toward each other.

8. The apparatus of claim 1, further comprising suspensible garment-hanging means comprising an elongate horizontally-extending member having opposed ends distal from a central hanging crook by which to suspend the member, said opposed ends defining upper hanging extremities for supporting a hanging garment, and downwardly extensible spacing means which, when extended, define lower spaced extremities for maintaining the lateral shape of a portion of the garment below a portion receiving support said said upper extremities.

9. The apparatus of claim 8, comprising at least one feature selected from:

said horizontally-extending member is telescopically extensible;

said horizontally-extending member comprises a vertically extensible element; and said vertically extensible element is connected by articulated connection means to said horizontally-extending member.

10. A method of ironing a fabric, said method comprising the steps of:

providing ironing apparatus comprising:

first and second opposable fabric-pressing surfaces, means comprising a body and first and second arm members extending from it, for supporting said respective surfaces in opposed relationship to define a fabric receiving gap;

means for urging said surfaces towards each other to narrow the gap from a first, fabric receiving width, to a second, fabric-compressing width effective for reducing creasing in the fabric, while permitting relative traversing movement between said surfaces and the fabric; and orienting means for causing tracking of said pressing surfaces to seek to assume a substantially parallel and opposed relative mutual orientation in use, said orienting means comprising features selected from:

tilt-enabling means for allowing the pressing surfaced to tilt axially and transversely in relation to said arm to which it is mounted and causing adjustment of the gap to accommodate variation in thickness of an article being ironed;

ball-mounting means disposed between said pressing surface and said arm;

biasing means located between one or both of said pressing surfaces and said arm to which it is mounted; and combinations thereof;

causing the gap to be at fabric-receiving width;

locating fabric requiring ironing in the gap while the gap is at fabric-receiving width;

operating the apparatus to urge said surfaces toward each other to narrow the gap to said fabric-compressing width; and causing said surfaces to traverse the fabric, so as to reduce creasing present therein to a desired degree.

11. The method of claim 10, wherein said arm members have capabilities selected from:

said first arm member being movably connected to said body and said second arm member is integrally formed with the body to extend therefrom in fixed orientation;

articulated connection means for movably connecting at least one arm to said body; and combinations thereof.

12. The method of claim 10, wherein at least one of said first and second arm members comprises first and second articulatedly interconnected arm portions.

13. The method of claim 12, wherein said first arm portion is proximate said body and located between said body and said articulatedly interconnected second portion, with said pressing surface being mounted on said second portion.

14. The method of claim 10, further comprising the step of heating at least one pressing surface using a heat source selected from electrical heat sources, steam, and combinations thereof.

15. The method claim 10, further comprising the step of introducing steam to the fabric.

16. The method of claim 15, further comprising the step of causing said apparatus to emit steam into the gap.

17. The method of claim 10, wherein said causing step comprises a step selected from:

maintaining the gap substantially constant at fabric-compressing width; and adjusting the gap according to variation in thickness of the fabric being ironed.

18. Ironing apparatus comprising:

opposable first and second fabric-pressing surfaces;

support means comprising a body and first and second arm members extending therefrom, said support means defining a flexible U-shaped member having opposed end portions defined by said first and second opposing arms, to which the respective pressing surfaces are mounted to be inwardly opposed for urging toward each other; and mounting means for mounting the pressing surfaces to said respective arm members;

wherein said body defines a generally central portion adapted for gripping by a human hand and comprises urging means operable to urge said first surface toward said second surface so that said pressing surfaces are in opposed relationship, whereby:

in use, a fabric-receiving gap is defined between said surfaces for receiving fabric to be ironed;

and the gap is narrowed from a first, fabric-receiving width, to a second, fabric-compressing width effective for exerting crease-reducing pressure on fabric located in the gap, while permitting relative traversing movement between said surfaces and the fabric.

* * * * *